US006631673B2

(12) United States Patent
Aichele

(10) Patent No.: US 6,631,673 B2
(45) Date of Patent: Oct. 14, 2003

(54) TRANSFER DEVICE FOR HOLLOW BODIES PRINTED OR TO BE PRINTED IN A PRINTING MACHINE

(75) Inventor: Helmut Aichele, Göppingen (DE)

(73) Assignee: Hinterkopf GmbH, Eislingen/Fils (DE)

( * ) Notice: Subject to any disclaimer, the term of this patent is extended or adjusted under 35 U.S.C. 154(b) by 138 days.

(21) Appl. No.: 09/792,058

(22) Filed: Feb. 26, 2001

(65) Prior Publication Data

US 2001/0025572 A1 Oct. 4, 2001

(30) Foreign Application Priority Data

Mar. 2, 2000 (DE) ..... 100 10 099

(51) Int. Cl.[7] ..... B41F 17/22

(52) U.S. Cl. ..... 101/40; 101/37; 101/40.1; 198/487.1

(58) Field of Search ..... 101/37, 38.1, 40, 101/40.1; 198/487.1, 441

(56) References Cited

U.S. PATENT DOCUMENTS

| | | | | |
|---|---|---|---|---|
| 3,563,170 A | * | 2/1971 | Cvacho et al. | 101/40 |
| 3,766,851 A | | 10/1973 | Sirvet et al. | |
| 4,404,900 A | * | 9/1983 | Ozawa et al. | 101/40 |
| 4,511,027 A | | 4/1985 | Zamboni | |
| 4,821,638 A | * | 4/1989 | Uithoven | 101/40 |
| 5,183,145 A | | 2/1993 | Williams et al. | |
| 5,231,926 A | * | 8/1993 | Williams et al. | 101/40 |
| 5,272,970 A | * | 12/1993 | Burke | 101/37 |
| 5,564,334 A | | 10/1996 | Burke | |
| 6,213,011 B1 | * | 4/2001 | Dubuit | 101/35 |

FOREIGN PATENT DOCUMENTS

| | | |
|---|---|---|
| FR | 2 748 454 | 11/1997 |
| GB | 2 073 662 | 2/1981 |
| WO | 93/06998 | 4/1993 |
| WO | 97/07979 | 3/1997 |

* cited by examiner

*Primary Examiner*—Andrew H. Hirshfeld
*Assistant Examiner*—Kevin D. Williams
(74) *Attorney, Agent, or Firm*—Browdy and Neimark, P.L.L.C.

(57) ABSTRACT

A transfer device with which the hollow bodies to be printed in a printing machine may be transferred from a supply conveyor means to a capstan plate associated with the printing device. Since the hollow bodies are supplied by the supply conveyor means with a distance between them, which is smaller than the pitch of the receiving capstans of the capstan plate serving to accept the hollow bodies, a transfer rotor is placed in between, which possesses holding units, which perform the hollow body transfer as part of a pitch matching operation. A similar arrangement may also be employed to transfer already printed hollow bodies from the capstan plate to a removal conveyor means.

18 Claims, 6 Drawing Sheets

TRANSFER DEVICE FOR HOLLOW BODIES PRINTED OR TO BE PRINTED IN A PRINTING MACHINE

BACKGROUND OF THE INVENTION

The invention relates to a transfer device for hollow bodies printed or to be printed in a printing machine, such as sleeves, collapsible tubes, cans or the like, for transferring the hollow bodies between a supply conveyor means and a rotary, driven capstan plate, said capstan plate being associated with the printing means of the printing machine, and/or between the capstan plate and a removal conveying means.

THE PRIOR ART

For printing on hollow bodies having a round outer shape such as collapsible tubes, cans or the like printing machines are available, which have a rotary, driven capstan plate having receiving capstans arranged in sequence in the direction of rotation, on which the hollow bodies are held during the printing operation. During such operation the receiving capstans move along a curved path, moving past the printing means, on rotation of the capstan plate.

The hollow bodies to be printed are supplied to the capstan plate by a supply conveyor means, which as a rule has an endless, circulating conveyor chain, on which bearer rods are arranged mounting the hollow bodies to be supplied. In a similar manner the removal of already printed hollow bodies takes place using a removal conveyor means. In this case a minimum distance apart of the sequentially following hollow bodies in the conveyor means is strived at in order to achieve a minimum overall size and maximum conveying speed. If the distance apart of the hollow bodies were for example to be equal to the pitch of the receiving capstans on the capstan plate, this would also mean a larger overall volume of any associated dryers, through which the hollow bodies are caused to pass. In the same way, at a certain frequency (number of strokes per unit time) and with a larger chain pitch the speed of the conveyor chain must be increased, something which means an increased rate of chain wear and a larger drive power.

The resultant different pitch of the receiving capstans of the capstan plate present and of the carrier rods of the conveyor means leads to a transfer problem on transfer of the hollow bodies between the respective conveyor means and the capstan plate. To the knowledge of the assignee attempts have generally been made so far to tackle this problem by multi-stage transfer operations, the hollow bodies being transferred between the conveyor means and the capstan plate several times between transfer drums of increasing pitch and correspondingly different speeds of rotation. Owing to the large number of transfer points there is however a large space requirement. Furthermore, the transfer operations are still far from perfect because of the different drum speeds and still prevent high speeds of conveying of the hollow bodies being achieved.

The patent publication WO 97/07979 describes a further design of the transfer device, in the case of which a transfer drum arranged adjacent to the capstan plate is utilized; but here again the drum has the same dimensions as the capstan plate and this generally leads to extremely large dimensions.

SHORT SUMMARY OF THE INVENTION

One object of the invention is to create a transfer device which in a high speed environment renders possible a reliable transfer of hollow bodies between on the one hand the capstan plate and on the other hand a supply conveyor means, which serves for the supply of the hollow bodies, and/or a removal conveyor means serving for removal of the hollow bodies.

In order to achieve these and/or other objects appearing from the present specification, claims and drawings, in the present invention a transfer device for hollow bodies printed or to be printed in a printing machine, such as sleeves, collapsible tubes, cans or the like, comprises:

- a rotary driven transfer rotor for transferring hollow bodies, supplied sequentially by way of a supply conveyor means, to rotary driven a capstan plate associated with the printing device of the printing machine and/or

- a rotary driven transfer rotor for the transfer of already printed hollow bodies from the rotary driven capstan plate to a removal conveyor means,
- holding units arranged at the transfer rotor sequentially in its direction of rotation, such holding units defining receiving sites for releasably holding hollow bodies to be transferred, which on rotation of the transfer rotor move along a first curved path, and receiving capstans serving for holding the hollow bodies during a printing operation, and which on rotation of the capstan plate move along a second curved path, the pitch of the holding units on moving past the supply and, respectively, removal conveyor means being matched to the spacing of the supplied and, respectively, removed hollow bodies and being smaller than the pitch of the receiving capstans on moving past the printing device,
- the holding units and/or the receiving capstans being able to be steplessly set to vary their pitch in a direction perpendicular to the axis of rotation of the associated transfer rotor or, respectively, capstan plate,
- means defining a transfer zone between the transfer rotor and the capstan plate, in which the hollow bodies are transferred between the receiving sites of the holding units of the transfer rotor and the receiving capstans of the capstan plate,
- and control means, by means of which the adjustable holding units and/or the receiving capstans are so able to be positioned in relation to one another that receiving sites and receiving capstans, just participating in a transfer operation, move along identical curved paths in pairs with a coaxial alignment at the same speed.

This means that even at high conveying speeds and with an extremely low supply and, respectively, removal body to body distance in comparison with the pitch of the receiving capstans provided on the capstan plate, it is possible to ensure a neat, continuous hollow body transfer between on the one hand the capstan plate and on the other hand a supply conveyor means and/or a removal conveyor means. The printing machine fitted with the transfer device may also be run in the high speed range. Transfer between a respective conveyor means and the capstan plate is implemented by a rotary driven transfer rotor, which is fitted with holding units, which respectively define a receiving site for a hollow body. By varying the distance between the holding units and the axis of rotation of the transfer rotor and/or by variation of the distance between the receiving capstans and the axis of rotation of the capstan plate, it is possible to so influence the curved paths moved along by the receiving sites and the receiving capstans that in a transfer zone between the transfer rotor and the capstan plate they have an identical curved path of movement with an identical speed and pitch. On moving along this path it is possible for the hollow bodies to be reliably transferred between receiving sites, which are arranged in pairs coaxially to one another, and the receiving capstans.

In order to provide the desired identical curved path in the transfer zone with a identical pitch it is possible to have exclusively a corresponding positioning of the holding units of the transfer rotor. In principle an exclusive positioning of the receiving capstans for this purpose would also be possible. Furthermore a positioning both of the receiving sites and also of the receiving capstans is possible, in which respect it is convenient for the major part of the positioning adaptation to be using the holder units, whereas on the part of the receiving capstan only a small positioning, which could be termed a path correction, will take place.

At this point it is to be noted that in the present invention the term "printing" or the like means any type of decoration of hollow bodies, any application of color or paint, labeling, foil embossing and screen printing coming into question. Accordingly the term "printing machine" means any machine adapted for the decoration of the type in question as mentioned.

Further advantageous developments of the invention are defined in the claims.

The mutually parallel axes of rotation of the transfer rotor and of the capstan plate are preferably so offset in relation to each other that the axis of rotation of the transfer rotor is outside the or complete (full loop) curved path of the receiving capstans. The distance of the two axes of rotation from the transfer zone is conveniently identical. In operation, rotation of the transfer rotor and of the capstan plate take place in opposite directions so that in the transfer zone the receiving sites and the receiving capstans move along paths in the same direction.

The control means contributing to presetting the identical curved paths on passing through the transfer zone may in principle be exclusively electronic and cause the desired pitch adaptation in accordance with the respectively detected instantaneous angular position of the transfer rotor and/or of the capstan plate. However it is preferred to use mechanical control means in a complementary manner or exclusively, such control means comprising at least one closed (full loop) cam face, on which cam followers run, which cooperate with the holding units and/or with the receiving capstans, on rotation of the transfer rotor in order to produce the desired positioning movement.

The transfer rotor is preferably drum-like in structure, the holding units being located more particularly on the radially outwardly directed peripheral face of the transfer rotor.

The bearing means for the adjustable holding units and/or the receiving capstans on the associated main body of the transfer rotor or, respectively, of the capstan plate preferably involves the use of radially telescoping guide means.

In order to hold the hollow bodies during the transfer operation between a conveyor means and the capstan plate the holding units may have suitable vacuum holding means, which are responsible for a fixing action due to the negative pressure. However, other suitable holding means would be possible.

The direct transfer between the transfer rotor and the capstan plate is preferably effected by the holding units, which for this purpose may be mounted on bearing means for adjustment in a transfer direction parallel to the axis of rotation of the transfer rotor and in order to perform a hollow body transfer operation on moving through the transfer zone are caused to carry out a transfer movement in the transfer direction, same respectively transferring one hollow body between mutually coaxial pairs of receiving sites and receiving capstans. Dependent on the direction of transfer the hollow bodies are then either placed on the receiving capstans, or doffed by the holding units.

The transfer movement is preferably performed in a fashion dependent on the instantaneous angular position of the transfer rotor, for which purpose suitable control means are provided.

The transfer of the hollow bodies between a respective conveyor means and the transfer rotor may take place in a similar manner, there being the possibility of simplification in as far as no pitch matching is necessary. The supply conveyor means and/or the removal conveyor means may respectively include a conveyor chain with sequentially following carrier rods for the hollow bodies, which in a supply zone, or respectively removal zone, located between the respective conveyor means and the transfer rotor, run along a supply curved path or, respectively, removal path, such path being identical to the curved path of motion of the receiving sites of the holding units, the carrier rods and the receiving sites being associated in pairs generally coaxially, something which owing to the doffing and putting on of hollow bodies permits transfer of bodies during the passage along the supply or, respectively, removal path.

In order to ensure that a hollow body is transferred extremely exactly to the transfer rotor, the supply conveyor means may have a rotatable centering wheel in the supply zone having an axis of rotation parallel to the axis of rotation of the transfer rotor and with centering pockets which are distributed in the direction in the peripheral direction and are open in an outward direction. The conveyor chain is so arranged that in the region preceding the supply path it follows an entry curve as set by the pitch circle of the centering pockets, hollow bodies supplied in operation being placed sequentially in such centering pockets. The arrangement is furthermore such that in the transition zone between the entry curve and the supply curve centering pockets of the centering wheel and receiving sites of the transfer rotor meet in pairs so that the hollow bodies may be received by the holding units defining the receiving sites.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

FIG. 1 diagrammatically shows part of printing machine, which is fitted with a preferred embodiment of the transfer device of the invention, a transfer unit serving for the supply of hollow bodies to the capstan plate being illustrated, whereas at another point on the periphery of the capstan plate there is a transfer unit serving for the removal of hollow bodies and furthermore, indicated in chained lines the printing device arranged at the periphery of the capstan plate.

DETAILED ACCOUNT OF WORKING EMBODIMENT OF THE INVENTION

Figure 1:
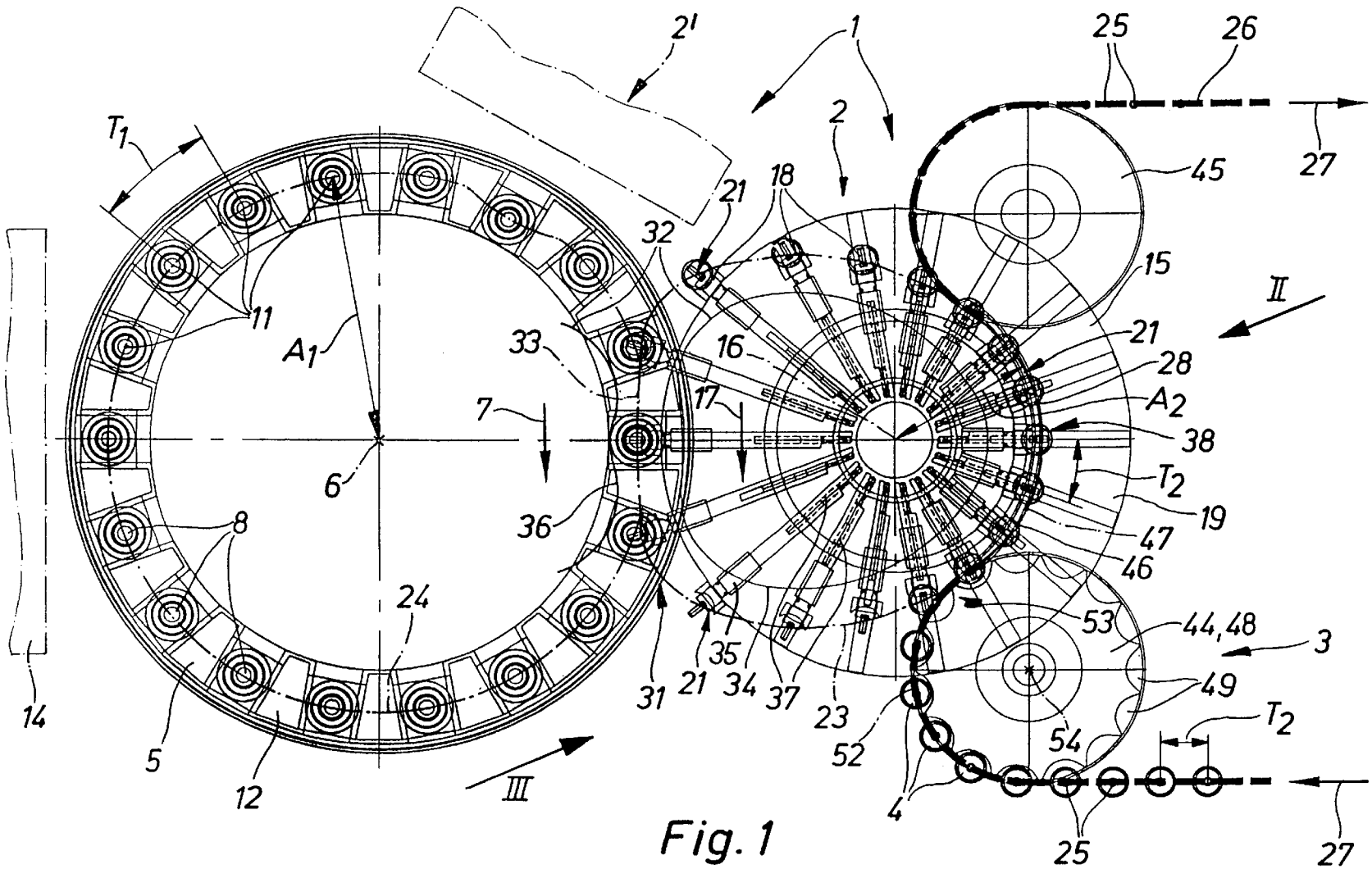
Figure 2:
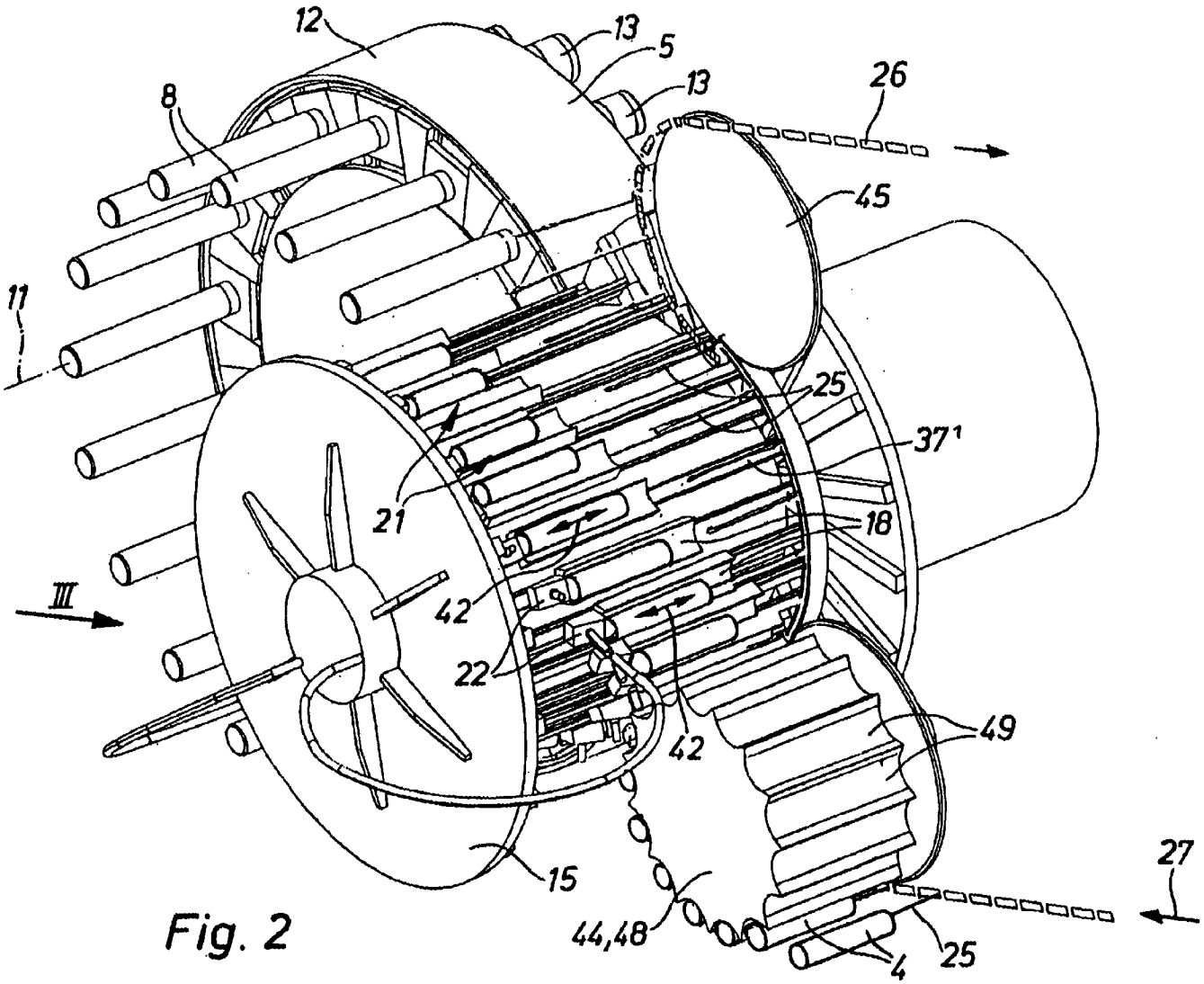
FIG. 2 shows the arrangement of FIG. 1 in an oblique perspective view looking generally in the direction of the arrow II of FIG. 1.
Figure 3:
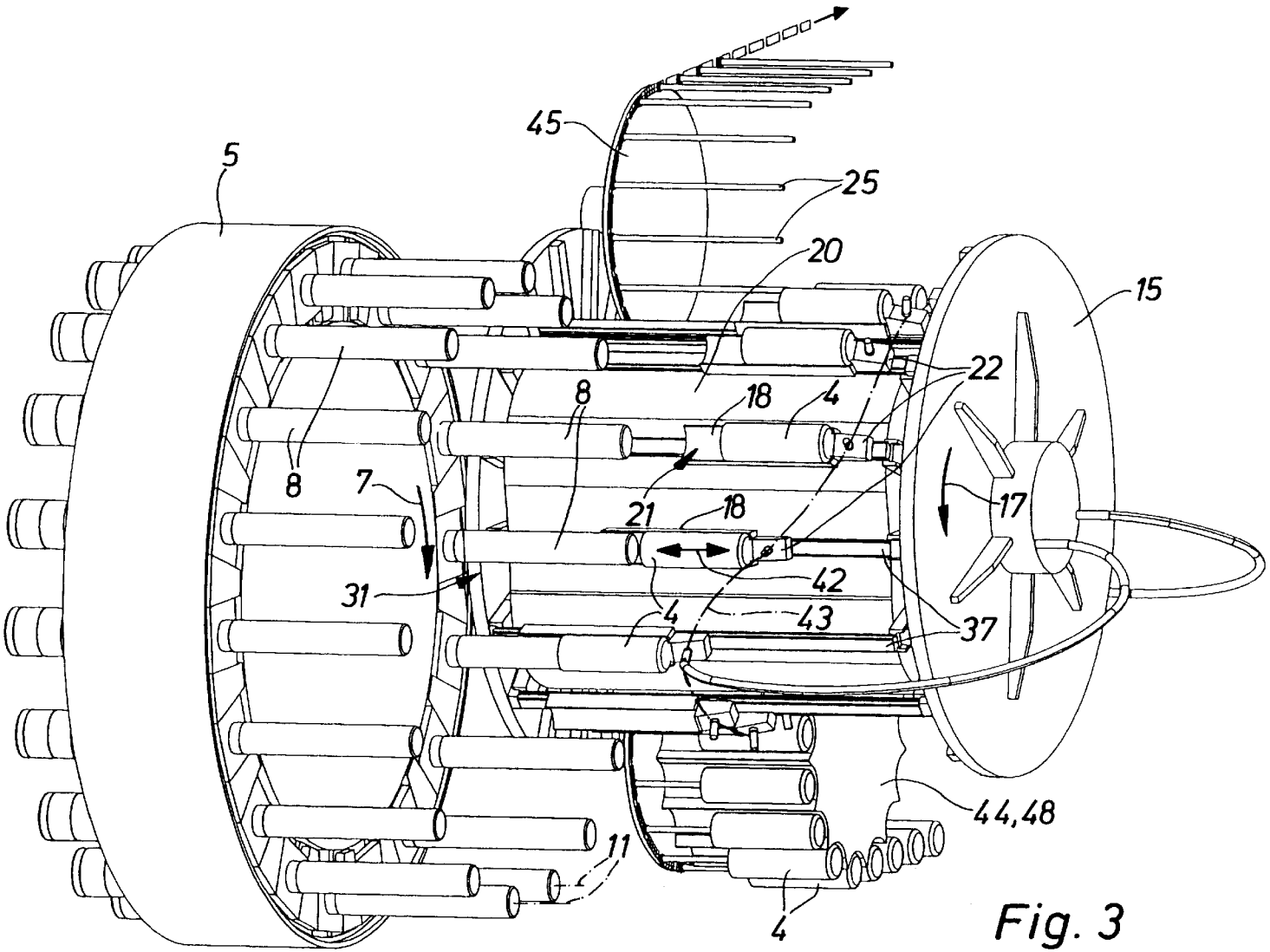
FIG. 3 shows the arrangement of FIG. 1 in a perspective view as indicated by the arrow III of FIG. 1.

The drawing shows part of a printing machine, which is fitted with a transfer device 1, which comprises a supply transfer unit 2 and a removal transfer unit 2'. The supply transfer unit 2 serves for the transfer of the bodies 4 to the capstan plate 5 of the printing machine and supplied by way of a supply conveyor means 3. By means of the removal transfer unit 2' already printed hollow bodies 4' are transferred from the capstan plate 5 to a removal conveyor means 3', which removes the printed hollow bodies 4'.

During operation the capstan plate 5 is able to be driven to perform a rotary movement about an axis 6 of rotation in a direction 7 as indicated by the arrow. The capstan plate 5 bears a plurality of receiving capstans 8 arranged sequentially in the direction 7 of rotation of the capstan plate, such capstans having their axis 11 (parallel to the axis 6 of rotation) extending away from the plate- or disk-like main body 12 of the capstan plate 5. The receiving capstans 8 may be provided with drive means 13, for performing rotation with the capstan axis 11 as the axis of rotation.

The drive means for rotating the capstan plate 5 are not illustrated in the drawing in detail.

The supply and removal transfer units 2 and 2' are placed with a spacing between them in the direction 7 of rotation of the capstan plate on the periphery of the capstan plate 5. Moreover, at the periphery of the capstan plate 5 there are furthermore the printing devices 14, only indicated in chained lines, which in a known fashion can be provided with several inking units and possesses a so-called printing cylinder, which applies ink to the hollow bodies 4 to be printed.

The printing machine serves for printing sleeves, collapsible tubes, cans or other symmetrical hollow bodies of revolution. The hollow bodies 4 to be printed are supplied by way of a supply conveyor means 3, are transferred by means of a transfer rotor 15 one after the other by the supply conveyor means 3 to the capstan plate 5 and thence passed from through the printing device 14. Then the printed hollow bodies 4' are transferred by a further transfer rotor 15', belonging to the removal transfer unit 2', from the capstan plate 5 to the removal conveyor means 3'.

While being on the capstan plate 5 the hollow bodies 4 and 4' are individually coaxially placed on the receiving capstans 8.

Each transfer rotor 15 and 15' is able to be driven by a drive means, not illustrated in detail, to perform a rotary movement around its axis 16 of rotation. The transfer rotor's direction of rotation is as indicated by the arrow 17.

In the working embodiment illustrated both transfer units 2 and 2' are designed in accordance with the invention. In principle it would however be possible to design only one transfer unit 2 and 2' in accordance with the invention and for the other transfer unit to be made using conventional means.

Each transfer rotor 15 and 15' is fitted with holding units 18 sequentially following each other in the direction 17 of rotation of the transfer rotor, such holding units defining respectively a receiving site 21 for releasably receiving or holding hollow bodies 4 and 4' to be transferred. The holding units 18 provided with holding means at the receiving sites 21 for holding the hollow bodies 4 and 4' for a time, such holding means preferably being vacuum holding means 22, which ensure holding of the hollow bodies 4 and 4' occupying the receiving sites 21 by means of the action of a negative pressure.

The holding units 18 are in the form of pockets at the receiving sites 21 and open radially inward so that the hollow bodies 4 and 4' may be inserted or put in or removed in a direction athwart the axis 16 of rotation.

Figure 4:
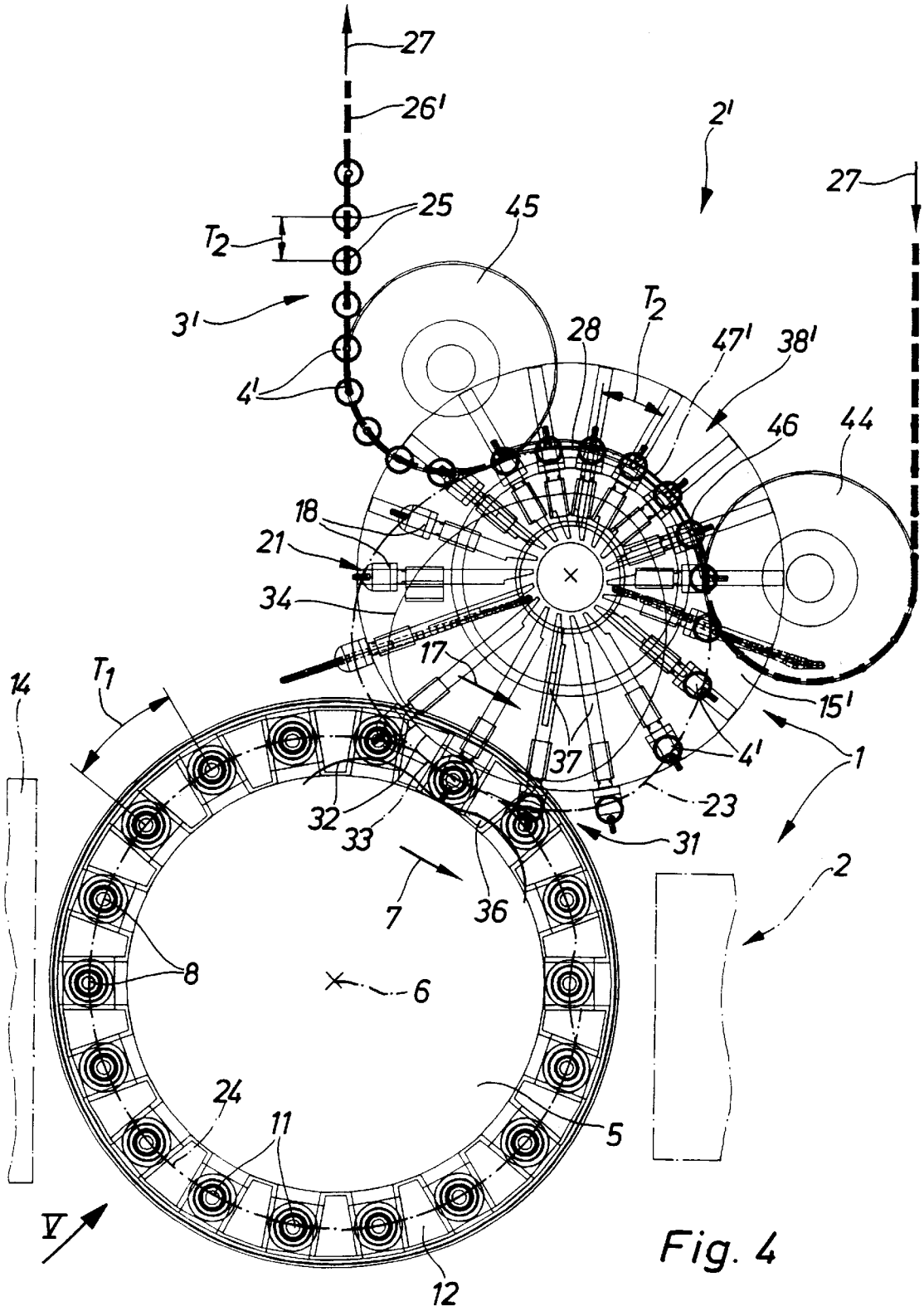
FIG. 4 shows the printing machine of FIG. 1, the transfer unit serving for the removal of printed hollow bodies being illustrated, while the transfer unit serving for the supply of hollow bodies to be printed, and also the printing device, is only indicated in chained lines.
Figure 5:
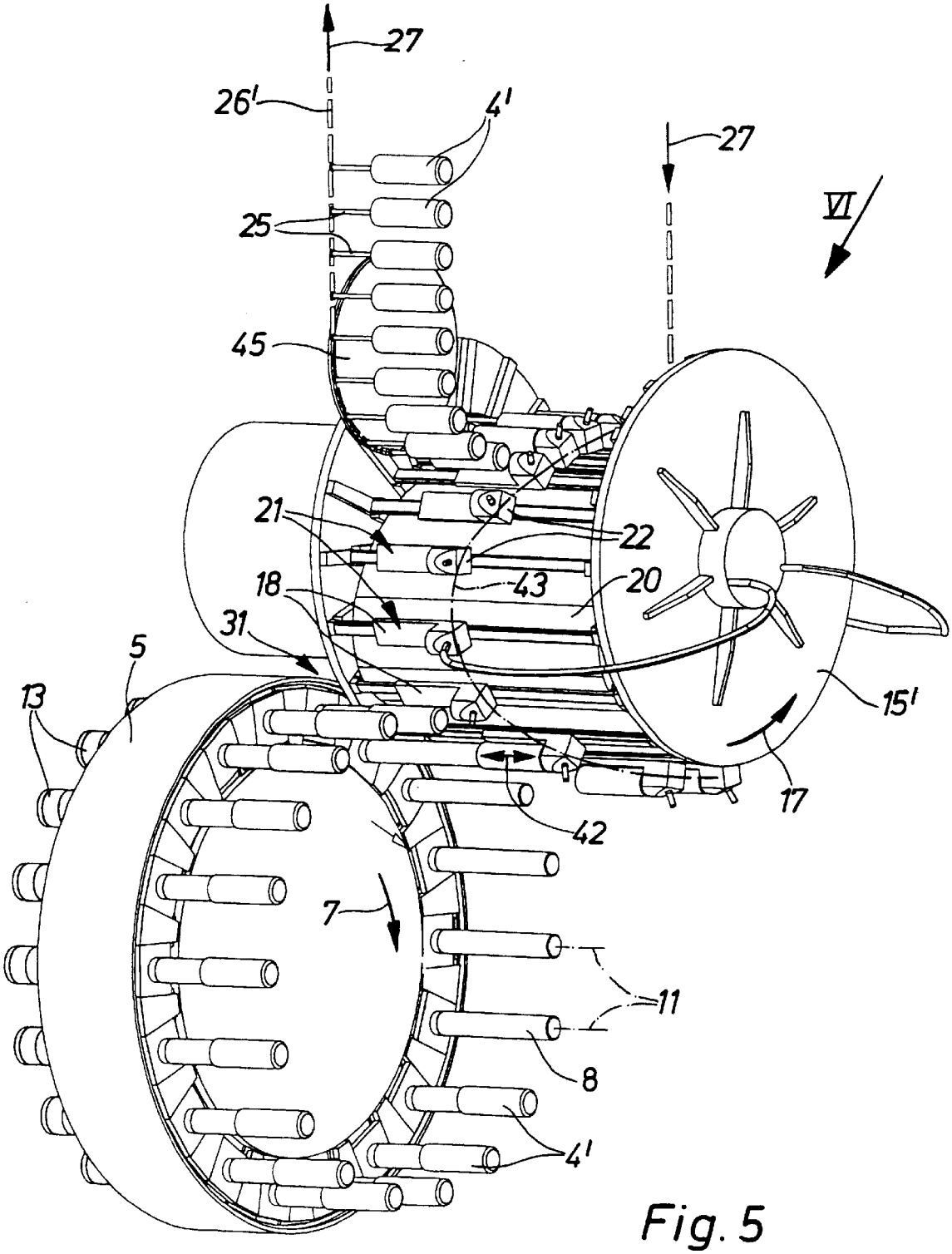
FIG. 5 shows the arrangement of FIG. 4 in a perspective view generally as indicated by the arrow V in FIG. 4.
Figure 6:
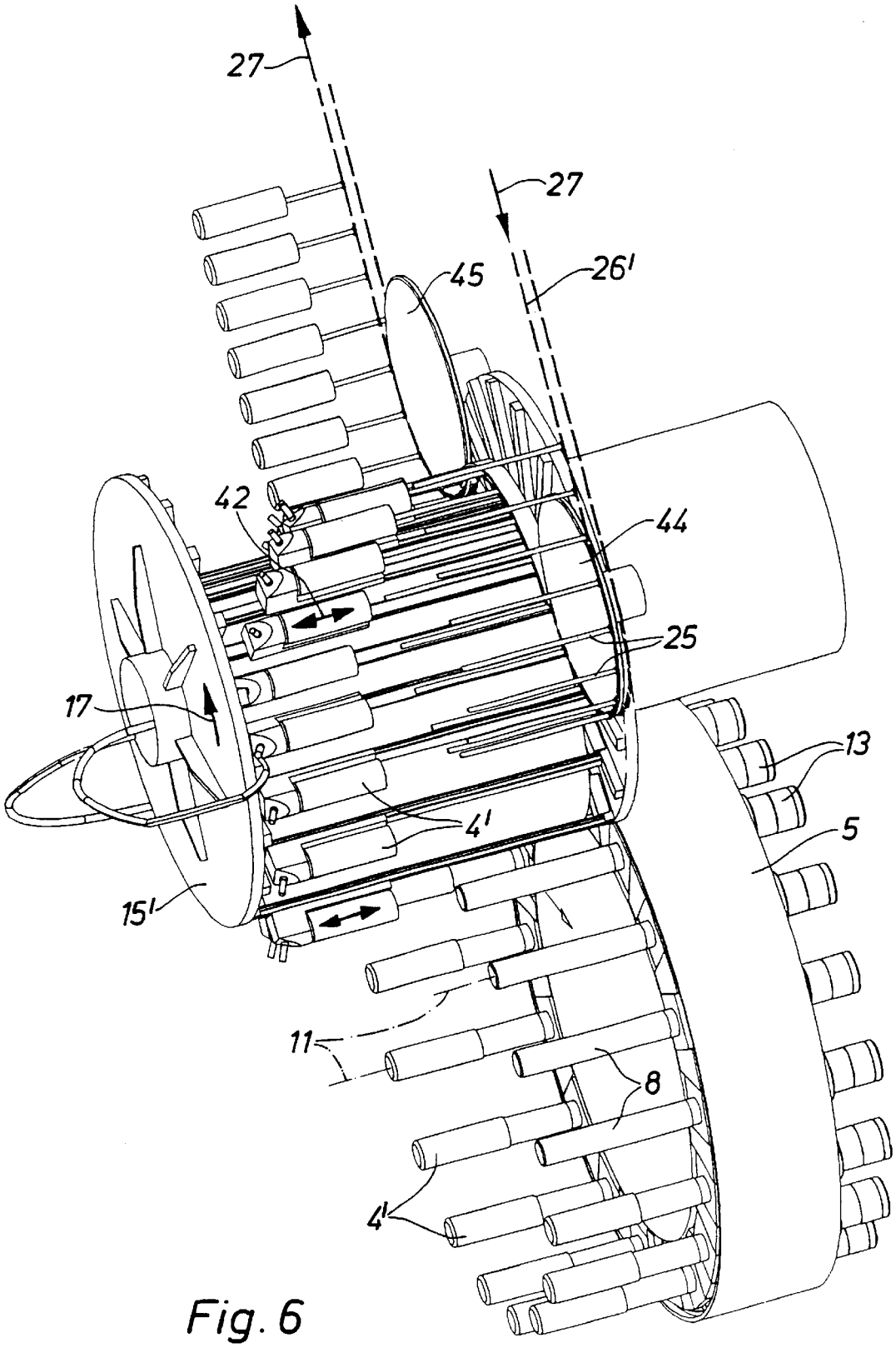
FIG. 6 shows the arrangement of FIGS. 4 and 5 in a perspective elevation generally as indicated by the arrow VI of FIG. 5.

The receiving sites 21 run along a first curved path 23 marked in chained lines in FIGS. 1 and 4 on rotation of the transfer rotor 15 and 15'. This path is closed or completed as a loop. Hollow bodies 4 and 4' secured at the receiving sites are moved along part of the length of this curved path 23 in a corresponding manner.

The receiving capstans 8 provided on the capstan plate 5 and accordingly the hollow bodies 4 and 4' held thereon are moved along a second curved path 24, on rotation of the capstan plate 5, as indicated in chained lines in FIGS. 1 and 4.

The pitch $T_1$, that is to say the distance in the direction 7 of rotation of the capstan plate between the axes 11 of two consecutive capstans 8, is relatively large and is more especially determined by the overall volume required for the rotary bearing means of the receiving capstans 8. In order to provide a sufficient number of receiving capstans 8 on the capstan plate 4, it is therefore also necessary to keep to a relatively large radial distance $A_1$ between the axis 6 of rotation of the capstan plate 5 and the respective capstan axis 11.

At the supply and removal conveyor means 3 and 3' circumstances are however different. In order to operate at high conveying speeds and simultaneously to minimize the overall volume of the printing machine and of any peripheral means such as dryers or the like, the hollow bodies 4 and 4' are supplied and removed with a minimum pitch $T_2$ that is to say with a minimum center to center distance between immediately following hollow bodies 4 and 4'. The pitch $T_2$ is in this respect set by the distance apart of carrier rods 25 placed directly behind one another in the direction of conveying, and which are so arranged in a parallel manner on a conveyor chain 26 and 26' of the supply and removal means 3 and 3' that same respectively extend away perpendicularly in relation to the peripheral direction, indicated as indicated by the arrows 27, of the respective conveyor chain 26 and 26' in the same direction. By means of a drive (not illustrated) the respective conveyor chain 22 and 22' loops are driven to perform an endless circulating movement in the peripheral direction 27.

With the aid of the supply and removal transfer units 2 and 2' the pitch difference $T_1-T_2$ is equalized so that a continuous transfer of hollow bodies with high transfer rates is possible. Here the hollow bodies are transferred between a respective supply and, respectively, removal conveyor means 3 and 3' and the associated transfer rotor 15 and 15' which as mentioned is matched to suit the distance apart of the hollow bodies 4 and 4' supplied and, respectively, removed by the conveyor means. The pitch of the holding units 18 and, respectively, of the receiving sites 21 defined by same is accordingly the same as in the transfer path section 28 (associated with the supply and removal conveyor means 3 and 3') preferably with the above mentioned pitch $T_2$ and is therefore substantially less than the pitch $T_1$ of the receiving capstans 8 on passing through the printing device 14.

The transfer of the hollow bodies 4 and 4' between the transfer rotor 15 and 15' and the capstan plate 5 takes place in a transfer zone 31, the pitches of the receiving capstans 8 and the receiving sites 21 being of the same size.

In order to produce this matching in pitch the course of the first and second curved paths 23 and 24 is variable. Thus the holding units 18 are able to be steplessly set athwart the axis of rotation of the transfer rotor 16 in order to change the distance $A_2$ between the receiving sites 21 and the axis 16 of rotation of the transfer rotor 15 and 15'. Much the same applies from the receiving capstans 8 which are able to be steplessly adjusted athwart the axis 6 of rotation capstan plate 5.

The holding units 18 and the receiving capstans 8 are provided with control means 32, by which the adjustable holding units 18 and/or receiving capstans 8 (which may be adjusted athwart the associated axis 16 and 6 of rotation) may be so positioned in relation to one another that the receiving sites 21 and the receiving capstans 8 run through the transfer zone 31 in pairs with a coaxial alignment, same being moved with the same speed and being moved along identical curved paths. The identical curved paths are indicated in FIGS. 1 and 4 at 33.

Accordingly the hollow bodies 4 and 4' may be transferred while on the identical curved paths 33 without difficulty from the receiving sites 21 of the transfer rotor 15 of the supply transfer unit 2 to the receiving capstans 8 of the capstan plate 5, or the other way round from the receiving capstans 8 of the capstan plate 5 to the receiving sites 21 of the transfer rotor 15' of the removal transfer unit 2'.

As shown in FIGS. 1 and 4, the radial lifting movement of the holding units 18 preferably takes place on the entire path section of the first curved path 23 clear of the transfer path section 28. In the case of the receiving capstans 8 on the contrary the radial lifting or stroke movement preferably takes place only during the passage along the identical path sections 33 or shortly before and/or shortly afterward. This is due to the fact that the lifting movement for adaptation of the shapes of the paths is less distinct in the case of the receiving capstans 8 than in the case of holding units 18, whose positioning path is generally responsible for the matching of pitch.

In order to reduce the complexity of the machine it would be in principle worthwhile attempting to adapt the curved paths on joint passage through the transfer zone 31 only by a controlled positioning of the holding units 18 and then adaptively changing the initial pitch $T_2$ to the larger pitch $T_1$, which has remained unchanged, of the receiving capstans 8. However in order to ensure a smooth course, free of points of inflexion, of the first curved path 23, in the working example on passage through the transfer zone 31, there is also a slight reduction in distance between the receiving capstans 8 and the axis 6 of rotation of the capstan plate 5.

The design of the arrangement in the example of the invention is such that the mutually parallel axes 6 and 16 of rotation of the capstan plate 5 and of a respective transfer rotor 15 and 15' are so arranged with a distance apart and a radial offset that the axis 16 of rotation of the respective transfer rotor 15 and 15' is outside the closed second curved path 24 of the receiving capstans 8. The capstan plate 5 and each respective transfer rotor 15 and 15' are so offset at a right angle to the axes of rotation that they only overlap in the transfer zone 31 somewhat to the side. Here the axes 6 and 16 of rotation of the capstan plate 5 and of the transfer rotors 15 and 15' are preferably arranged at the same distance from the transfer zone 31.

In operation the capstan plate 5 and the transfer rotors 15 and 15' turn in the opposite direction so that in the overlapping transfer zone 31 there are path movements of the receiving sites 21 and of the receiving capstan 8 in the same direction.

The path control of the holding units 18 and/or of the receiving capstans 8 could in principle take place and be caused without making contact. In the working embodiment illustrated however recourse is had to mechanical means. Thus for angular position-dependent radial positioning of the holding units 18 and therefore for presetting the first curved path 23 the control means 32 comprise a closed or full loop, stationary cam face 34, on which during rotation of the transfer rotor 15 and 15' cam followers run, which cooperate with the holding units 18, in order to cause positioning dependent of the instantaneous angular position of the transfer rotor 15 and 15'. The curve or cam followers 35 may have rolling bodies to reduce friction.

A similar arrangement is also possible as regards the receiving capstans 8, the corresponding cam face 36 being able to have a smaller extent and not having to be a complete loop, since owing to the above mentioned circumstances essentially only an effect on the receiving capstans 8 currently moving through the transfer zone 31 is necessary. As an alternative it would be possible to provide other control means in order to cause only a minimum displacement of the receiving capstans on their passage along identical curved paths 33.

As shown in FIGS. 2, 3, 5 and 6 the transfer rotors 15 and 15' preferably possess a drum-like structure, the holding units 18 being located at the outwardly facing peripheral face of the respective transfer rotor 15 and 15'. In this respect the holding units 18 may, as illustrated, be adjustably mounted on the principal body 19 of the respective transfer rotor 15 and 15' with the aid of guide means 37, such guide means being able to telescope radially in relation to axis 16 of rotation of the transfer rotor 15 and 15'. It is preferred for the telescoping guide means to possess components able to slide on one another like carriages, sliding guide means or rolling element means being able to be utilized is desired.

During one rotation of the transfer rotor 15 associated with the supply transfer unit 2 the receiving sites 21 are moved out of the supply zone 38 associated with the supply conveyor means 3 into the transfer zone 31, preferably with a continuously increasing size of the transverse distance from the axis 16 of rotation, starting from the supply zone 38 associated with the supply conveyor means 3. Following this the radial distance apart is reduced again down to the minimum distance corresponding to the pitch $T_2$, on re-entering the supply zone 38. A type of motion applying here results in connection with the transfer rotor 15' of the removal transfer unit 2', the only difference being that instead of the supply zone 38 there is a removal zone 38', in which the printed hollow bodies 4' are passed on to the removal conveyor means 3'.

At least during a part of the displacement taking place on passage along the first curved path 23 the holding units 18 are also caused to perform a simultaneous transfer movement in a transfer direction 42 as indicated by the double arrow. This transfer direction 42 is parallel to the axis 16 of rotation of the associated transfer rotor 15 and 15' and accordingly also directed in the same direction as the capstan axis 11 of the receiving capstans 8.

The transfer movement is so controlled by control means 43 as indicated in chained lines that in the case of the supply transfer unit 2 the receiving sites 21 having a hollow body 4 to be printed are placed, on entry in the transfer zone 31, aligned with a coaxial extension of the receiving capstans 8. A hollow body 4 held thereon therefore is axially opposite to the respectively associated receiving capstan 8. During the further course of the rotary motion of the transfer rotor 15 the respective holding units 18 are shifted toward the synchronously moving receiving capstans 8, the entrained hollow body 4 being placed on the receiving capstan 8. At the end of the identical curved paths 33 it is consequently possible for the engagement between the holding units 18 and the associated hollow bodies to be discontinued, since same are now seated in or at the receiving sites 8.

A movement with the opposite direction of transfer takes place in the case of transfer rotor 15' of the removal transfer unit 2'. In this case the holding units 18 are so placed on entering the transfer zone 31 that their receiving sites 21 coincide with a hollow body 4' held on a receiving capstan 8. The vacuum holding means 22 or the like are then activated in order to retain the already printed hollow body 4' on the holding unit 18, following which same are doffed from the receiving capstan 8 on further passage through the transfer zone 31 in the transfer direction 42, the hollow body 4 being simultaneously removed from this receiving capstan 8.

The control means 43 responsible for the transfer movement may be at least partly identical to the control means 32 implementing the pitch matching.

The cam face responsible for the radial lifting movement of the holding units and the cam responsible for the transfer movement may be integral, and provided for instance of the stator 20 of the transfer rotor 15 and 15'.

In order to perform an accurate transfer movement the holding units 18 are adapted to move as slides on suitable guide means on the transfer rotor 15 and 15' in the working example of the invention, the guide means being provided on the above mentioned guide means 37 or being directly formed by same.

The drum-like transfer rotor 15 and 15', which rotates during operation, preferably comprises a principal body 19 with two discs arranged axially on either side of the stationary stator 20, which discs are connected fixedly together by means of a shaft extending through the stator 20 and are only able to rotate together. On the inner faces facing the stator 20 axially the above mentioned discs are provided with radially extending guide rails 37', on which the guide means 37 are mounted for radial displacement. The guide means may have a yoke-like structure with two lateral guide arms and a connecting section extending therebetween, the arms fitting around the guide rails 37' like clips. The connecting section serves for bearing the associated holding unit 18 like a sliding carriage and is located on the radially facing peripheral portion of the stator 20. The guide arms fit laterally around the two terminal faces of the stator 20 and engage guides arranged internally on the discs for providing a guiding function in a radial direction.

On the two axially facing faces of the stator 20 turned toward the disks there is a respective cam face 34, the two cam faces 34 having an identical form. Each guide arm is provided with a cam follower 35, which cooperates with the associated cam curve 34. It is in this manner that an extremely reliable bilateral actuation and guiding of each respective guide means 37 is made possible. When the transfer rotor 15 and 15' rotates the connecting sections of the guide means 37 move together and the holding units 18 running on the same move in the peripheral direction along the peripheral face of the stator 20, their radial distance from the axis 16 of rotation of the transfer rotor 15 and 15' being changed in a manner dependent on the course of the cam curves 34.

This radial motion is, as mentioned, combined with the transfer movement in the transfer direction 42. For this purpose it is possible for the control means 43 to comprise a cam face in the form of a full loop extending around the stator 20 on the periphery thereof so that each respective holding unit 18 engages it for a cam function. Each holding unit 18 may for this purpose be provided with a suitable cam follower. Along the periphery of the stator 20 there is a change in the axial distance of the cam face from the terminal faces of the stator 20 in accordance with the desired axial displacement of the holding units 18.

In order to render possible the hybrid or combined radial and transfer motion without losing the guiding engagement between the holding units 18 and the stator 20 necessary for the transfer movement and simultaneously to have a simple design, the cam face of the control means 43 is not concentric to the axis 16 of rotation of the transfer rotor 15 and 15'. For this purpose it is best provided on the peripheral face of the stator 20 which has an outline whose course is the same as that of the terminal cam faces 34. The radial distance of the cam face, which is responsible for the transfer motion, of the control means 43 from the axis 16 of rotation varies in accordance with the course of the cam faces 34 responsible for the radial motion. It is in this manner that we ensure that the guiding engagement is never lost. The non concentric and preferably non circular periphery of the stator 20 is to be seen in FIGS. 3 and 6 for instance.

Owing to the particular design of the guide means 37 there is an accurate guiding action for the carriage-like holding units 18, which independently of their particular position are at all times located at the radially outwardly facing peripheral face of the drum-like transfer rotor 15 and 15'. This means that there is always an extremely accurate transfer of each hollow body 4 between a holding unit 18 and a receiving capstan 8.

The transfer of the hollow bodies 4 and 4' between the carrier rods 25 of each respective supply and, respectively, removal conveyor means 3 and 3' and the respectively associated transfer rotor 15 and 15' takes place in a manner similar to the transfer between the transfer rotor 15 and 15' and the capstan plate 8. In this case also the holding units 18 are displaced in the transfer direction 42 in order to either doff the hollow bodies 4 and 4' from the carrier rods 25 or to place them on them. This transfer operation takes place in the supply zone 38 and, respectively, the removal zone 38' on passage along the arcuate transfer curved path section 28, which is for instance in the form of part of a circle.

The supply and, respectively, removal conveyor means 3 and 3' is best located in a peripheral part, opposite to the capstan plate 5, of the associated transfer rotor 15 and 15'. Here there are two bend wheels 44 and 45, spaced apart in the peripheral direction of the transfer rotor 15 and 15', and having axes of rotation parallel to the axis 16 of rotation of the transfer rotor 15 and 15'. One point of its outer periphery is respectively on the transfer path section 28, same having the conveyor chain 26 and 26', or a similar conveyor traction element means, partly trained around it so that there is a conveyor traction element section 46 which coincides with the transfer path section 28 of the first curved path 23. This means that during circulation of the conveyor chain 26 and 26' the carrier rods are forced to follow a supply curve and, respectively, a removal curve 47 and 47' corresponding to the transfer path section 28. During this movement of the rods 25 they and the receiving sites 21 of the holding units 18 are generally arranged in pairs coaxially so that the combined transfer movement of the holding units 18 renders possible doffing of the hollow bodies 4 to be printed, and, respectively, putting on already printed hollow bodies 4' from and, respectively, on the carrier rods 25.

The two bend wheels 44 and 45 are accordingly arranged on the input and output sides of the respective supply curve 47 and, respectively, removal curve 47' in the direction of rotation of the transfer rotor 15 and 15'.

It is preferred for the bend wheel 44 on the input side of the supply curve 47, of the supply conveyor means to be designed in the form of a centering wheel 48, which on its outer periphery is provided with centering pockets 49, which are distributed in the peripheral direction and are each radially open in an outward direction. Their pitch is the same as the pitch $T_2$ of the supplied hollow bodies 4 and the identical pitch $T_2$ of the receiving sites 21 within the transfer path section 28. In other words in the region preceding the supply curved path 47 the conveyor chain 26 passes through an entry curved path 52, curved in the opposite direction to the supply curved path, such curve being set by the pitch circle of the centering pockets 49.

The angular positions of the centering wheel 48 and of the transfer rotor 15 are so matched to one another that in the transfer region 53 between the entry curved path 52 and the supply curved path 47, centering pockets 49 and receiving sites 21 come together in pairs, between which hollow body transfer may then take place.

The centering wheel 48 ensures an accurately centered transfer of the hollow bodies 4 to be printed to the transfer rotor 15.

By way of conclusion it remains to be pointed out that the term "printing" or the like means any type of decoration of hollow bodies, any application (not only by printing) of color or paint, labeling, foil embossing and screen printing coming into question. Accordingly references to a printing machine or a printing device are to be understood to mean references also to machines and devices suitable for applying such decoration, as for example lacquering or labeling machines.

What is claimed is:

1. A transfer device for hollow bodies printed or to be printed in a printing machine such as sleeves, collapsible tubes, or cans, comprising:

a first rotary driven transfer rotor for transferring hollow bodies, supplied sequentially by way of a supply conveyor means, to a rotary driven capstan plate associated with a printing device of the printing machine, having receiving capstans serving to hold the hollow bodies during a printing operation at a transfer zone and/or a second rotary driven transfer rotor for the transfer of already printed hollow bodies from the rotary driven capstan plate at a transfer zone between said transfer rotor and the capstan plate, in which the hollow bodies are transferred between receiving capstans of the capstan plate and receiving sites of the transfer rotor, wherein, each said transfer rotor comprises;

a stationary stator;

two discs respectively engaged on opposite ends of the stationary stator to rotate together around an axis of rotation of the transfer rotor;

a plurality of guide means parallel to the axis of rotation slidably engaged between the two discs on guide rails, said guide rails extending out radially from a center of each of the discs;

a plurality of holding units defining the receiving sites for holding the hollow bodies to be transferred, each of the holding units slidably engaged on each one of the guide means and arranged on the transfer rotor sequentially in a direction of rotation thereof;

wherein the holding units move along a first curved path when the transfer rotor is rotating, and the receiving capstans move along a second curved path when the capstan plate is rotating, first control means for radially adjusting the guide means on the guide rails, so as to vary a pitch between the holding units in a direction perpendicular to the axis of rotation during rotation of the transfer rotor, and second control means for sliding the holding means on the guide means to a position coaxial with a receiving capstan during rotation of the transfer rotor;

wherein the first control means includes two identical first cam curves respectively located on two axially oriented faces on the stator and a cam follower at opposite ends of each of the guide means respectively engaged to slide in the two identical cam curves, and wherein the second control means comprises a second cam curve on the periphery of the stator and a cam follower on each of the holding units slidably engaged in the second cam curve.

2. The transfer device as set forth in claim 1, wherein parallel axes of rotation of the transfer rotor and of the capstan plate are so offset in relation to one another that the axis of rotation of the transfer rotor is outside the second curved path, which is a closed loop, of the receiving capstans.

3. The transfer device as set forth in claim 2, wherein the transfer rotor and the capstan plate are arranged to rotate in opposite directions so that motion is initiated at the transfer zone along curved paths of the holding units and of the receiving capstans.

4. The transfer device as set forth in claim 1, wherein the first curved path of the receiving sites has an arcuate course on passage past the supply and, respectively, removal conveyor means.

5. The transfer device as set forth in claim 1, wherein a distance of the receiving sites from the axis of rotation of the transfer rotor on passage of the supply and, respectively, removal conveyor means is smaller than the distance of the receiving capstan from the axis of rotation of the capstan plate on passage through the printing device.

6. The transfer device as set forth in claim 1, wherein in order to maintain the identical curved paths during passage through the transfer zone, the holding units of the transfer rotor are positioned and are matched to the second curved path of the receiving capstans.

7. The transfer device as set forth in claim 1, wherein the first control means comprise a stationary cam face associated with the holding units to be positioned, along which cam face cam followers run cooperating with the holding units during rotation of the transfer rotor in order to cause a positioning movement, dependent on a current position of the transfer rotor and furthermore influencing the respective curved path, of the holding unit.

8. The transfer device as set forth in claim 1, wherein the transfer rotor is drum-shaped, the holding units being placed on a radially outwardly facing peripheral face of the drum-shaped transfer rotor.

9. The transfer device as set forth in claim 1, wherein the holding unit can be positioned to influence the course of a curved path of the receiving capstans and are adjustably mounted by way of guide means on the principal body of the transfer rotor or, respectively, the capstan plate.

10. The transfer device as set forth in claim 1, wherein the holding units comprise vacuum holder means for retaining hollow bodies during the transfer operation.

11. The transfer device as set forth in claim 1, wherein the holding units are carried by bearing means for adjustment in a transfer direction parallel to the axis of rotation of the transfer rotor and can perform a hollow body transfer operation on passage through the transfer zone by control means to cause a transfer movement in a transfer direction, wherein each of the holding units can transfer a hollow body between coaxial pairs of receiving capstans.

12. The transfer device as set forth in claim 11, wherein said control means is adapted to cause a presetting of an angular position of the transfer rotor dependent on the angular position of the transfer rotor.

13. The transfer device as set forth in claim 11, wherein the holding units are mounted as carriages on the guide means of the transfer rotor for setting in the transfer direction.

14. The transfer device as set forth in claim 1, wherein the supply conveyor means and/or the removal conveyor means respectively have a conveyor traction element, constituted by a conveyor chain, with sequentially placed carrier rods for the hollow bodies, which pass in a supply zone or, respectively, removal zone located between the respective conveyor means and the transfer rotor along a supply or removal curved path identical to the curved path of the receiving sites of the holding units, the carrier rods and the receiving sites being arranged generally coaxially in pairs and between them a transfer of the hollow bodies take place.

15. The transfer device as set forth in claim 11, wherein the supply conveyor means and/or the removal conveyor means respectively have a conveyor traction element, constituted by a conveyor chain, with sequentially placed carrier rods for the hollow bodies, which pass in a supply zone or, respectively, removal zone located between the respective conveyor means and the transfer rotor along a supply or removal curved path identical to the curved path of the receiving sites of the holding units, the carrier rods and the receiving sites being arranged generally coaxially in pairs and between them a transfer of the hollow bodies takes place, the holding units being mounted as carriages on the guide means of the transfer rotor in the transfer direction, and wherein the hollow body transfer is caused by a displacement of the holding units taking place in the transfer direction.

16. The transfer device as set forth in claim 14, wherein at a supply conveyor zone, the supply conveyor means possesses a rotary centering wheel with an axis of rotation parallel to the axis of the rotation of the transfer rotor, the conveyor traction element following an entry curved path set by a pitch circle of centering pockets in a region preceding the supply curved path and the arrangement is such that in a transition region between the entry curved path and the supply curved path centering pockets of the centering wheel of the transfer rotor come together in pairs, between which the transfer of the hollow bodies takes place.

17. The transfer device as set forth in claim 14, wherein the traction element of the supply conveyor means and/or the removal conveyor means is respectively trained around two bend wheels preceding and, respectively, following the supply curved path and, respectively, the removal curve path.

18. The transfer device as set forth in claim 1, wherein the receiving capstans can be steplessly set to vary a pitch thereof in a direction perpendicular to the axis of rotation of the transfer rotor upon rotation of the transfer rotor.

* * * * *